US008474638B2

(12) United States Patent
Pedmo et al.

(10) Patent No.: US 8,474,638 B2
(45) Date of Patent: Jul. 2, 2013

(54) PLASTIC CONTAINER

(75) Inventors: Marc A. Pedmo, Brunswick, OH (US); James C. Dorn, Norton, OH (US); James J. Miller, Barberton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 960 days.

(21) Appl. No.: 11/181,177

(22) Filed: Jul. 14, 2005

(65) Prior Publication Data

US 2005/0284840 A1 Dec. 29, 2005

Related U.S. Application Data

(60) Division of application No. 10/786,265, filed on Feb. 25, 2004, now abandoned, which is a continuation-in-part of application No. 29/196,399, filed on Dec. 29, 2003, now Pat. No. Des. 527,645.

(51) Int. Cl.
*B65D 90/02* (2006.01)

(52) U.S. Cl.
USPC ..... 215/381; 215/379; 215/384; 215/382

(58) Field of Classification Search
USPC ..... 215/379, 380, 382
See application file for complete search history.

(56) References Cited

U.S. PATENT DOCUMENTS

| | | | | | |
|---|---|---|---|---|---|
| D205,798 | S | * | 9/1966 | Parcels | D9/550 |
| D206,193 | S | * | 11/1966 | Gooding | D9/542 |
| D212,277 | S | * | 9/1968 | Heintze | D9/563 |
| D212,278 | S | * | 9/1968 | Weckman | D9/550 |
| D6,489 | S | * | 3/1973 | Sawyer | D9/544 |
| 4,387,816 | A | * | 6/1983 | Weckman | 215/381 |
| 5,261,544 | A | * | 11/1993 | Weaver, Jr. | 215/384 |
| 5,303,834 | A | * | 4/1994 | Krishnakumar et al. | 215/381 |
| 5,337,924 | A | * | 8/1994 | Dickie | 222/212 |
| D365,752 | S | * | 1/1996 | Flanagan-Boos et al. | D9/658 |
| D419,887 | S | * | 2/2000 | Dugan | D9/542 |
| 6,044,996 | A | * | 4/2000 | Carew et al. | 215/381 |
| D480,005 | S | * | 9/2003 | Conway | D9/530 |
| 6,814,248 | B2 | * | 11/2004 | Beck et al. | 215/384 |
| 6,838,138 | B1 | * | 1/2005 | Akiyama et al. | 428/35.7 |

* cited by examiner

*Primary Examiner* — Tri Mai
(74) *Attorney, Agent, or Firm* — Dykema Gossett PLLC

(57) ABSTRACT

The plastic container includes a hollow body of plastic material having a lower supporting base, a sidewall extending upwardly from the lower base and an upper neck portion extending upwardly from the sidewall with an opening therein. The sidewall includes at least one panel having a central region and an outer boundary, with the outer boundary being depressed with respect to the central region.

14 Claims, 4 Drawing Sheets

PLASTIC CONTAINER

CROSS-REFERENCE TO RELATED APPLICATIONS

This application is a Division of U.S. patent application Ser. No. 10/786,265, filed Feb. 25, 2004 now abandoned, which in turn is a continuation-in-part of U.S. patent application Ser. No. 29/196,399, filed Dec. 29, 2003 now U.S. Pat. No. D,527,645.

BACKGROUND OF THE INVENTION

The present invention relates to a blown plastic container that is suitable for the packaging of juice or other beverages, wherein the container is covered with a closure after the liquid has been introduced therein.

It is highly desirable to provide a plastic container wherein at least a portion of the sidewall can readily flex inwardly upon vacuum or physical depression. The flexing of the sidewall should permit the plastic container to maintain its structural integrity as a vacuum is applied when the container is filled with a hot product and then cooled. The sidewall flexing should also allow the container to displace internal volume and allow for the sidewall to return to the original form after depression. The flexing of the sidewall is also desirable to permit product to be easily and readily displaced from the container.

Accordingly, it is an objective of the present invention to provide an improved plastic container which permits inward flexing of the sidewall.

It is a further objective of the present invention to provide a plastic container with an improved sidewall configuration.

It is a still further object of the present invention to provide a container as aforesaid which has good product characteristics.

Further objects and advantages of the present invention will appear hereinbelow.

SUMMARY OF THE INVENTION

In accordance with the present invention the foregoing objects and advantages are readily obtained.

The plastic container of the present invention comprises: a hollow body of plastic material having a lower supporting base, a sidewall extending upwardly from the lower base, and an upper neck portion with an opening therein, said neck portion extending upwardly from the sidewall; wherein the sidewall includes at least one panel having a central region and an outer boundary, with the outer boundary being depressed with respect to the central region, with the depressed outer boundary having side portions and top and bottom portions; and wherein said sidewall includes opposed sidewall sections with said at least one panel at least in part extending substantially across a sidewall section. Preferably, at least part of the side portions of the outer boundary of said at least one panel run adjacent the edges of a sidewall section.

In a preferred embodiment the depressed outer boundary comprises a substantially continuous, channel-like structure. In another preferred embodiment two opposed sidewall sections each include one of said panels. The panels can be oval, round or square with rounded corners.

In a further embodiment of the present invention the container sidewall has a lower portion and an upper portion, with said at least one panel on the lower portion. Preferably, two of the panels are on the lower portion, with each of said panels being positioned on opposed sidewall sections.

In a still further embodiment of the present invention the outer boundary includes two, parallel, outer boundary portions spaced from each other with the parallel outer boundary portions being generally centrally located on said panel to separate said panel into side by side panel portions.

Further features of the present invention will appear hereinbelow.

BRIEF DESCRIPTION OF THE DRAWINGS

The present invention will be more readily understandable from a consideration of the accompanying exemplificative drawings, wherein.

DETAILED DESCRIPTION OF PREFERRED EMBODIMENTS

Figure 2:
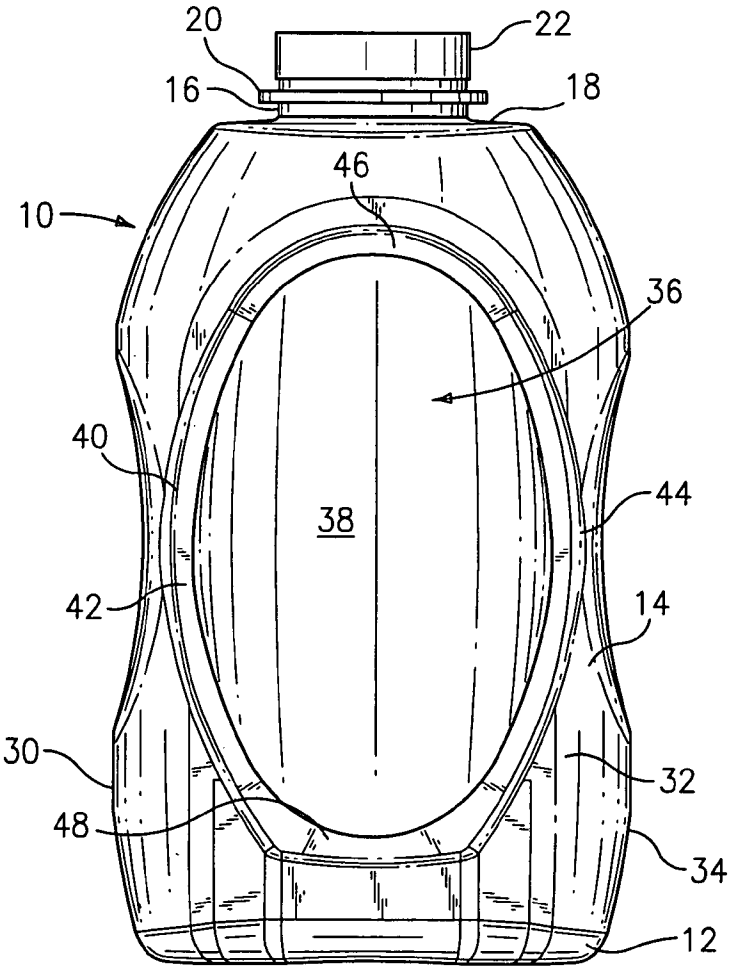
FIG. 2 is a rear view of the container of FIG. 1 showing the rear thereof.
Figure 1:
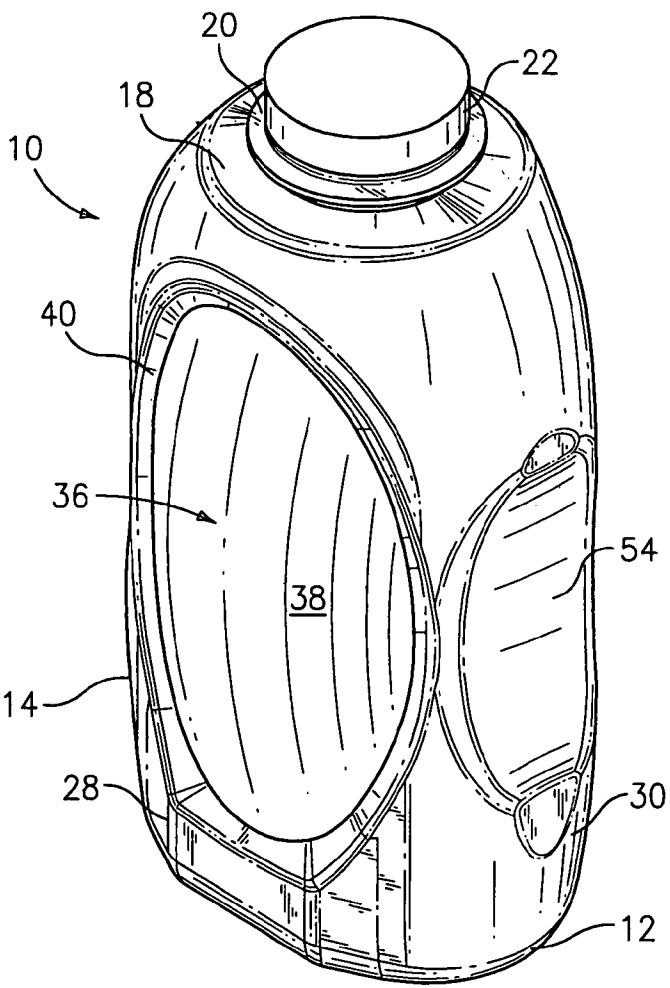
FIG. 1 is a perspective view of the container of the present invention showing the front and right side thereof.
Figure 3:
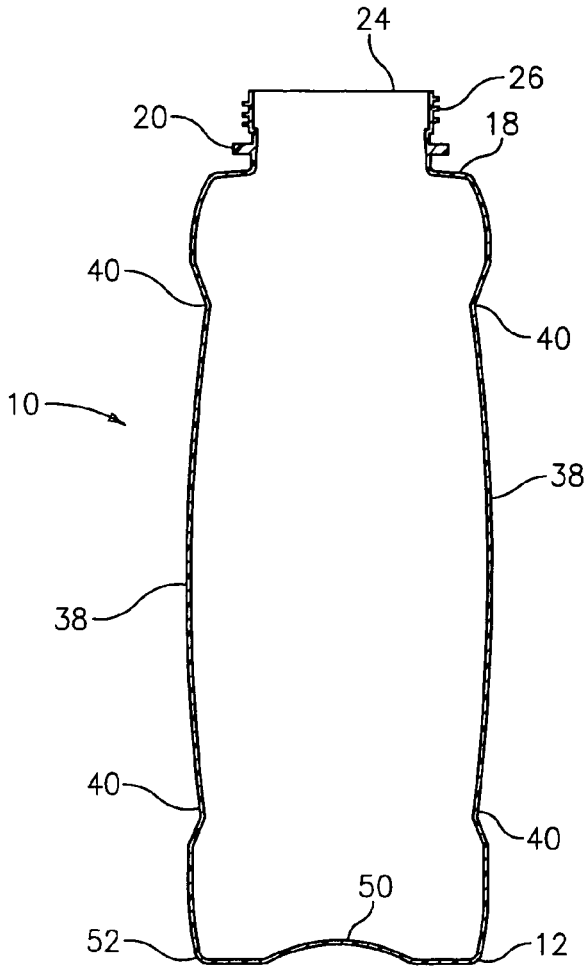
FIG. 3 is a sectional side view of the container of FIG. 1.

FIGS. 1-2 show a typical container 10 of the present invention having a lower supporting base 12, a sidewall 14 extending upwardly from the base 12, and an upper neck portion 16 extending upwardly from the sidewall. A shoulder portion 18 is between the sidewall 14 and upper neck portion 16 and extends generally inwardly of the sidewall. The upper neck portion 16 includes an outwardly extending flange 20 and a removable closure 22 above the flange, which may be a threaded or snap-on closure. As shown in FIG. 3, the upper neck portion 16 has an opening 24 therein and may include threads 26 to accept a threaded closure.

The sidewall 14 includes opposed sidewall sections, with FIG. 1 showing front sidewall section 28 and right sidewall section 30, and FIG. 2 showing rear sidewall section 32 and right sidewall section 30 and left sidewall section 34. Opposed front 28 and rear 32 sidewall sections are essentially identical, and opposed right 30 and left 34 sidewall sections are also essentially identical.

The sidewall 14 includes at least one panel 36 extending substantially across a sidewall section and having a central region 38 and a channel-like outer boundary 40 circumscribing the central region, with the outer boundary 40 being depressed with respect to the central region. In the embodiment FIGS. 1-4, two of said panels 36 are provided, one on each of opposed front sidewall section 28 and rear sidewall section 32. In the embodiment of FIGS. 1-4, panels 36 are of oval configuration and occupy the major portion of their respective sidewall section, each extending substantially across their corresponding sidewall section.

The depressed outer boundary 40 has a generally oval configuration and includes side boundary portions 42, 44, a top boundary portion 46 and a bottom boundary portion 48, with the outer boundary running continuously around the periphery of panel 36. Desirably, at least part of the side portions 42,44 of the outer boundary 40 of panel 36 run adjacent the edges of the respective sidewall sections, as shown.

Advantageously, panel 36 can readily flex inwardly upon vacuum or physical depression. The flexing of the sidewall panel or panels permits the container to maintain its structural integrity as a vacuum is applied when the container is filled with a hot product and then cooled. The sidewall flexing also allows the container to displace internal volume and allow the sidewall to return to the original configuration after depressing. Further, and also advantageously, the sidewall flexing permits the product to be readily displaced from the container.

Naturally, the shape and configuration of the panel 36 may vary depending on desired configuration. For example, the panels may, if desired, be oval as shown in FIGS. 1-4, or round, or square with rounded corners. Similarly, the outer boundary may be continuous or discontinuous.

Base 12 may have any desired configuration. Preferably, base 12 includes an inwardly depressed portion 50 and a peripheral supporting rim 52, but the specific configuration may vary. For example, a heat set base may be used in a heat set container.

The container 10 in the embodiment of FIGS. 1-4 is essentially rectangular; however, the container may have any desired configuration, as essentially round, oval or square.

The front sidewall section 28 and rear sidewall section 32 are larger than the right sidewall section 30 and left sidewall section 34 in the embodiment of FIGS. 1-4. Also, the right and left sidewall sections 30, 34 each include an oval depressed section 54, which provides a convenient area for handling.

Figure 7:
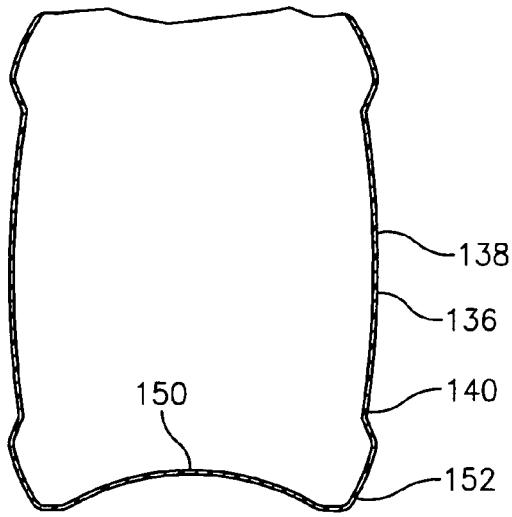
FIG. 7 is a partial sectional view through line 7-7 of FIG. 6.
Figure 4:
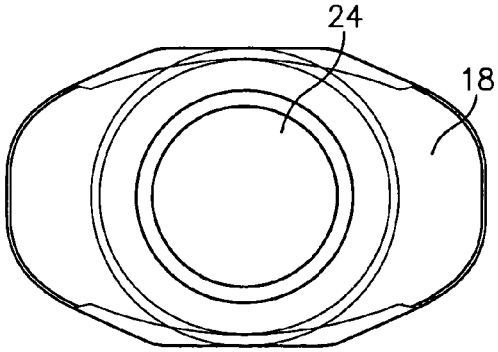
FIG. 4 is a top view of the container of FIG. 1.
Figure 6:
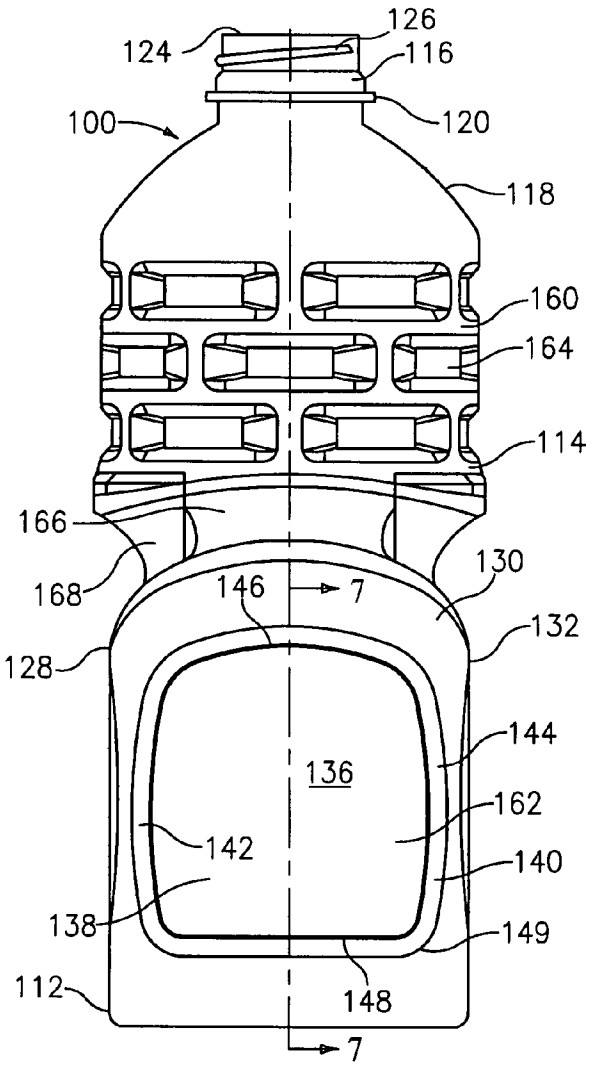
FIG. 6 is a side view of the container of FIG. 5 showing the right side thereof.
Figure 5:
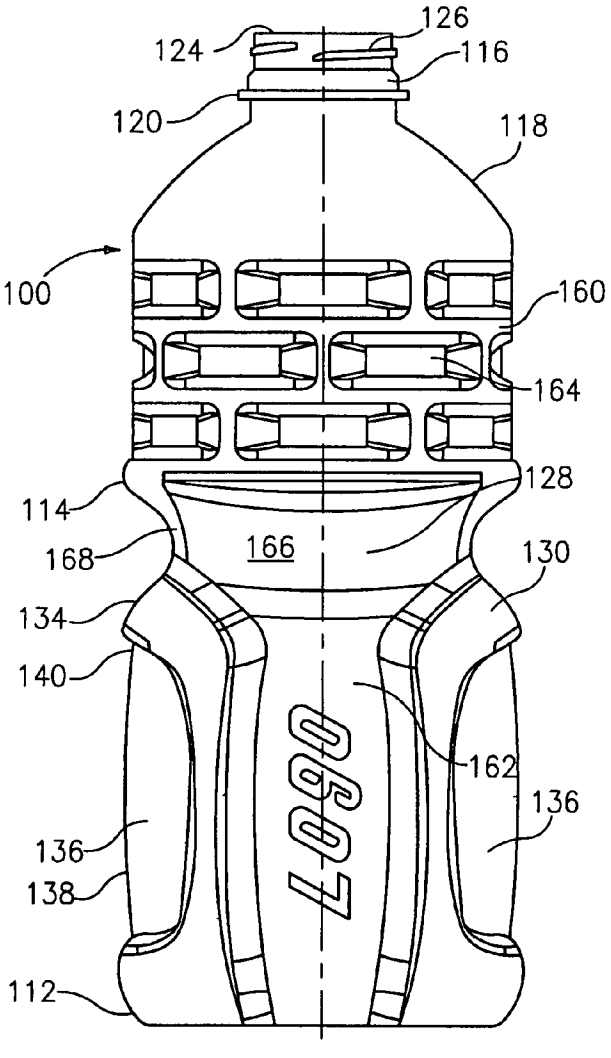
FIG. 5 is a side view of an alternate embodiment of the container of the present invention showing the front thereof.

The embodiment of FIGS. 5-7 show container 100 having a lower supporting base 112, a sidewall 114 extending upwardly from the lower base, and an upper neck portion 116 extending upwardly from the sidewall. A shoulder portion 118 is provided between the sidewall 114 and upper neck 116. The shoulder 118 extends generally inwardly and upwardly of the sidewall 114. The upper neck portion 116 includes an outwardly extending flange 120, an opening 124 to the interior of the container, and a threaded portion 126 to accommodate a threaded closure.

Similar to the embodiment of FIGS. 1-4, container 100 includes front sidewall section 128, right sidewall section 130, rear sidewall section 132, and left sidewall section 134. However, container 100 is essentially round.

In addition, sidewall 114 of container 100 includes an upper portion 160 and a lower portion 162, with panels 136 on lower portion 162 on opposed right sidewall section 130 and left sidewall section 134.

Panels 136, similar to panels 36, extend substantially across a sidewall section and have a central region 138 and a channel-like outer boundary 140 circumscribing the central region, with the outer boundary 140 being depressed with respect to the central region 138 as clearly shown in FIG. 7. In the embodiment of FIGS. 5-7, two of panels 136 are provided, one on each of opposed right sidewall section 130 and left sidewall section 134, on the lower sidewall portion 162. However, panels 136 have a square configuration with rounded corners. Also, panels 136 each extend substantially across their corresponding sidewall sections.

The depressed outer boundary 140 has a generally square configuration and includes side boundary portions 142, 144, a top boundary portion 146 and a bottom boundary portion 148, with curved corner portions 149 and with the outer boundary running continuously around the periphery of panel 136. Desirably, at least part of the side portions 142, 144 of the outer boundary 140 of panels 136 run adjacent the edges of the respective sidewall section, as shown.

In the embodiment of FIGS. 5-7, upper sidewall portion 160 includes a plurality of brick-like panels 164 extending around the circumference of the container. Naturally, other features may if desired be provided around the upper sidewall portion. The front and/or rear sidewall sections 128, 132 may include a logo or design Logos or designs may also be placed on other regions as well as on the embodiment of FIGS. 1-4. The base 112 preferably includes an inwardly depressed portion 150 and a peripheral supporting rim 152, with specific base configurations as desired.

Sidewall 114 of container 100 also includes central sidewall portion 166 between lower sidewall portion 162 and upper sidewall portion 160. Central sidewall portion 166 is depressed with respect to the lower and upper sidewall sections and includes outwardly extending vertical columns 168 to aid in gripping. The central sidewall portion allows for increase in top load and provides a convenient site for gripping.

The embodiment of FIGS. 5-7 obtains advantages as in the embodiment of FIGS. 1-4. However, variations in both embodiments may readily be made depending on particularly desired results, as, for example, the location and size of the panels.

Figure 10:
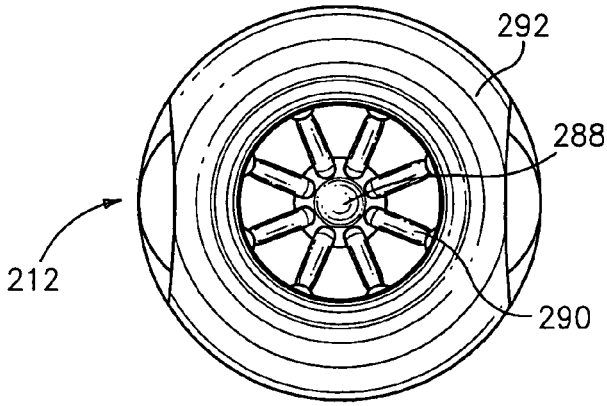
FIG. 10 is a bottom view of the container of FIG. 8.
Figure 9:
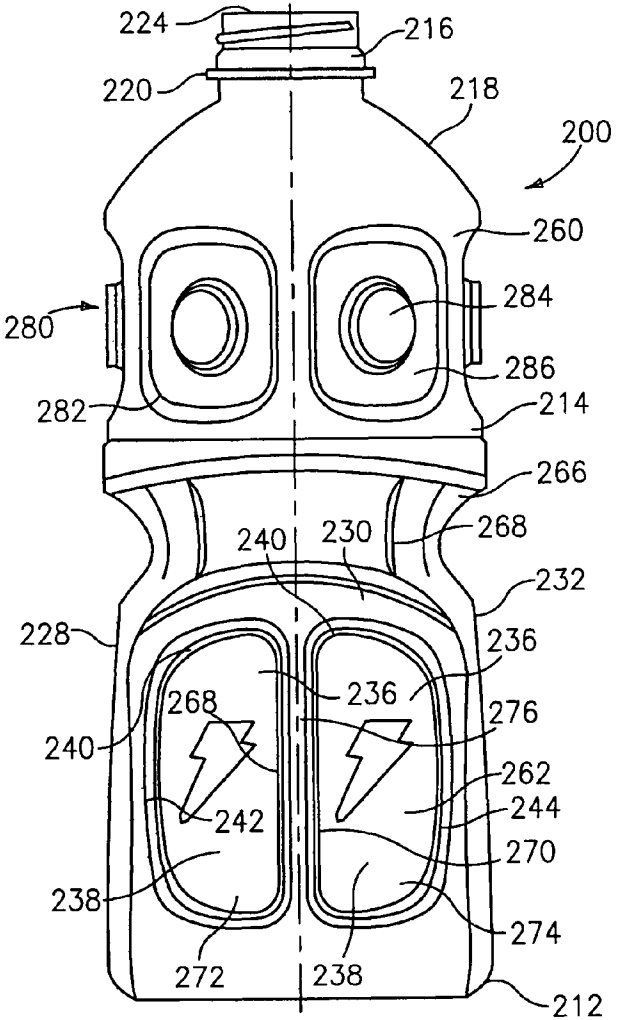
FIG. 9 is a side view of the container of FIG. 8 showing the right side thereof.
Figure 8:
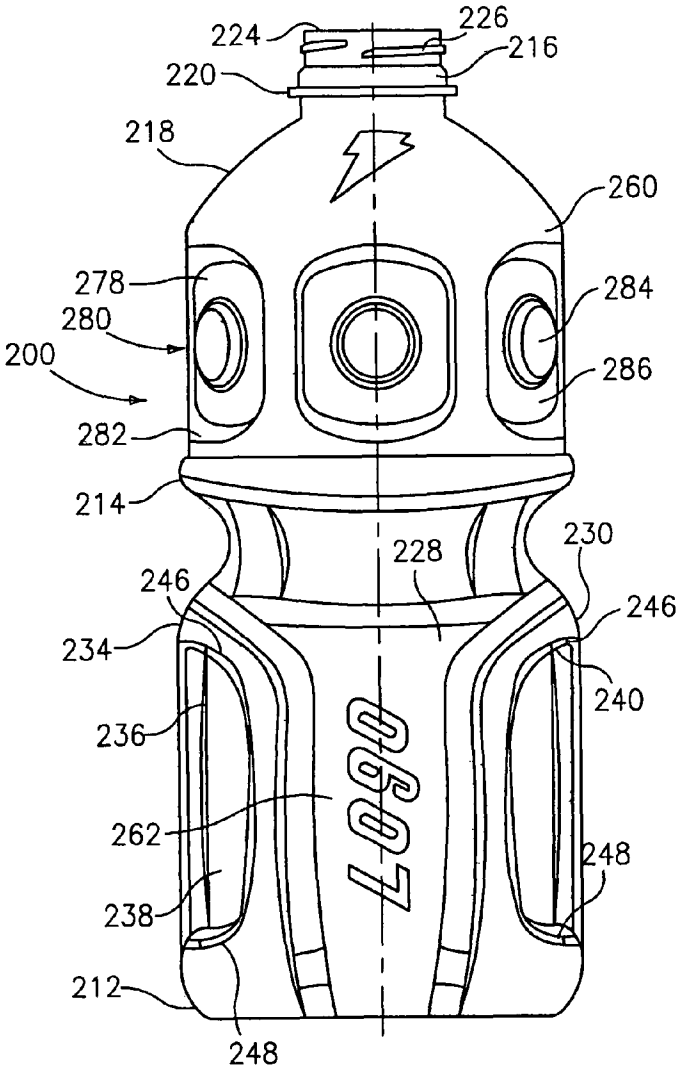
FIG. 8 is a side view of a further embodiment of the container of the present invention showing the front thereof.

Similar to the embodiment of FIGS. 5-7, the embodiment of FIGS. 8-10 show container 200 having a lower supporting base 212, a sidewall 214 extending upwardly from the lower base, and an upper neck portion 216 extending upwardly from the sidewall. A shoulder portion 218 is provided between the sidewall 214 and upper neck 216. The shoulder 218 extends generally inwardly and upwardly of the sidewall 214. The upper neck portion 216 includes an outwardly extending flange 220, an opening 224 to the interior of the container, and a threaded portion 226 to accommodate a threaded closure.

Similar to previous embodiments, container 200 includes front sidewall section 228, right sidewall section 230, rear sidewall section 232, and left sidewall section 234. Container 200 is essentially round.

In addition, sidewall 214 of container 200 includes an upper portion 260 and a lower portion 262, with panels 236 on lower portion 262 on opposed right sidewall section 230 and left sidewall section 234.

Panels 236, similar to panels 36 and 136, extend substantially across a sidewall section and have a central region 238 and a channel-like outer boundary 240 circumscribing the central region, with the outer boundary being depressed with respect to the central region. However, outer boundary 240 includes two, parallel, closely adjacent central side outer boundary portions 268, 270 spaced from each other, with the parallel side outer boundary portions being centrally located on panel 236 to separate panel 236 into side by side panel portions 272 and 274.

The side by side panel portions 272, 274 are separated by a vertical land 276. The parallel outer boundary portions as well as the outer boundary 240 are depressed with respect to the vertical land 276.

Side by side panel portions 272, 274 are positioned on lower sidewall portion 262. Upper sidewall portion 260 includes a plurality of upper panels 278 spaced from each other and circumscribing sidewall 214. The upper panels 278 have a central region 280 and an outer boundary 282. Central region 280 includes a raised central area 284 surrounded by a depressed peripheral region 286, with the outer boundary 282 being depressed with respect to peripheral region 286. The raised central region 280 provides support for a desired label, while the depressed peripheral region 286 and outer boundary 282 as configured helps top load and provides assistance under vacuum. The depressed peripheral region 286 would move inwardly under vacuum, but the raised central area 284 would still support a label. Also, the depressed peripheral region 286 would provide support for the base by minimizing upward movement of the base under vacuum.

Container 200 includes a recessed base 212. The recessed base provides additional support under vacuum. Advantageously, central base portion 288 is recessed, and a plurality of outwardly extending struts 290 are disposed between central base portion 288 and peripheral base rim 292. The peripheral base rim 292 provides stability for the container. Naturally, other base features can be provided to give the base vacuum support, and these can be used on other embodiments as well.

Container sidewall 214 includes a central sidewall portion 266 between the upper sidewall portion 260 and lower sidewall portion 262. The central sidewall portion 266 is recessed with respect to the lower sidewall portion 262 and upper sidewall portion to provide a convenient site for gripping. Conveniently, central sidewall portion 266 includes outwardly extending vertical columns 268 which also aid in gripping, similar to the embodiment of FIGS. 5-7. The recessed central sidewall portion also allows for increase in top load.

If desired, additional logos, designs or designations can be provided on other areas of the container as shown in FIGS. 8-9, such as on shoulder 218 or panels 236.

As shown in FIGS. 8-9, outer boundary 240 includes side boundary portions 242, 244, parallel side boundary portions 268, 270, top boundary portions 246, and bottom boundary portions 248. These boundary portions define the side by side panel portions 272,274, with the outer boundary being recessed with respect to central panel region 236.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container, which comprises:

a hollow body of plastic material having a lower supporting base, a sidewall extending upwardly from the lower base, and an upper neck portion with an opening therein, said neck portion extending upwardly from the sidewall;

wherein the sidewall includes at least one panel having a central region and an outer boundary, with the outer boundary being depressed with respect to the central region and with the depressed outer boundary having side portions and top and bottom portions, wherein the depressed outer boundaries comprise substantially continuous, channel-like structures which substantially circumscribe the central regions;

wherein said sidewall has two opposed relatively larger sidewall sections which alternate with two opposed relatively smaller sidewall sections, including a single one of said panels with outer boundary on each of the opposed relatively larger sidewall sections, with each panel extending over a major portion of their corresponding sidewall section and at least in part extending substantially across their corresponding sidewall section, wherein each of said panels can flex inwardly under vacuum and return to the original configuration, and wherein each of the opposed smaller sidewall sections including an inwardly depressed panel, with each of the inwardly depressed panels on opposed smaller sidewall sections having an oval configuration and including side portions thereof which are adjacent a depressed outer boundary of a sidewall panel of the larger sidewall sections, wherein each of said larger sidewall sections include a single one of said panels with outer boundary, and each of the smaller sidewall sections include a single one of said inwardly depressed panels including side portions thereof which are adjacent a depressed outer boundary of a sidewall panel of the larger sidewall sections; and wherein at least part of the side portions of the outer boundary of said panels on the larger sidewall sections extends to the edges of the larger sidewall sections.

2. A container according to claim 1, wherein said panels on the larger sidewall sections are one of oval, round and square with rounded corners.

3. A container according to claim 2, wherein said panels on the larger sidewall sections are oval.

4. A container according to claim 1, wherein said container is essentially rectangular.

5. A container according to claim 1, including a shoulder portion between the sidewall and upper neck portion.

6. A container according to claim 5, wherein the shoulder portion extends generally inwardly of the sidewall.

7. A container according to claim 5, wherein the upper neck portion includes an outwardly extending flange.

8. A container according to claim 7, wherein the upper neck portion includes a removable closure above the outwardly extending flange.

9. A container according to claim 5, wherein the container is essentially rectangular.

10. A container according to claim 1, wherein at least part of the side portions of the outer boundary of said panels on the smaller sidewall sections extend to the edges of the smaller sidewall sections.

11. A container according to claim 1, wherein the outer boundary of the panels of the larger sidewall sections contact or intersect with the outer boundary of the panels of smaller sidewall sections.

12. A plastic container comprising:

a hollow body of plastic material having a lower supporting base, a sidewall extending upwardly from the lower base, and an upper neck portion with an opening therein, said neck portion extending upwardly from said sidewall;

wherein said sidewall has two opposed relatively larger sidewall sections which alternate with two opposed relatively smaller sidewall sections; each of the larger and smaller sidewall sections includes an oval-shaped panel; and the panels of the larger sidewall sections contact or intersect adjacent panels of the smaller sidewall sections at or about a transition point between the adjacent larger and smaller sidewall sections.

13. A container according to claim 12, wherein each of the panels in the larger sidewall section include a central region and a channel-like outer boundary that circumscribes the central region.

14. A container according to claim 13, wherein the channel-like outer boundary is depressed relative to the central region.

* * * * *